US010177443B2

(12) United States Patent
Xue et al.

(10) Patent No.: US 10,177,443 B2
(45) Date of Patent: Jan. 8, 2019

(54) COMMUNICATION ANTENNA, METHOD FOR CONTROLLING THE SAME AND TERMINAL

(71) Applicant: Beijing Xiaomi Mobile Software Co., Ltd., Hadian District, Beijing (CN)

(72) Inventors: Zonglin Xue, Beijing (CN); Linchuan Wang, Beijing (CN); Xiaofeng Xiong, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 93 days.

(21) Appl. No.: 15/378,635

(22) Filed: Dec. 14, 2016

(65) Prior Publication Data

US 2017/0346159 A1 Nov. 30, 2017

(30) Foreign Application Priority Data

May 30, 2016 (CN) ..... 2016 1 0371760

(51) Int. Cl.
*H01Q 1/24* (2006.01)
*H01Q 5/314* (2015.01)
(Continued)

(52) U.S. Cl.
CPC ..... *H01Q 1/243* (2013.01); *H01Q 1/48* (2013.01); *H01Q 1/50* (2013.01); *H01Q 5/314* (2015.01); *H01Q 5/371* (2015.01); *H01Q 9/42* (2013.01)

(58) Field of Classification Search
CPC ..... H01Q 19/00; H01Q 19/005; H01Q 5/378; H01Q 5/49; H01Q 5/30
See application file for complete search history.

(56) References Cited

U.S. PATENT DOCUMENTS 5,815,804 A 9/1998 Newell et al.
5,969,582 A 10/1999 Boesch et al.
(Continued)

FOREIGN PATENT DOCUMENTS

CN 1349681 A 5/2002
CN 101873382 A 10/2010
(Continued)

OTHER PUBLICATIONS

International Search Report and Written Opinion issued in corresponding International Application No. PCT/CN2016/095644, dated Feb. 6, 2017, 11 pages.
(Continued)

*Primary Examiner* — Dieu Hien T Duong
*Assistant Examiner* — Bamidele A Jegede
(74) *Attorney, Agent, or Firm* — Arch & Lake LLP

(57) ABSTRACT

A communication antenna, a method for controlling a communication antenna and a terminal are provided. The communication antenna includes a first passive unit, a stimulation receiving unit, and a second passive unit. The first passive unit and the second passive unit are respectively coupled to ground. The stimulation receiving unit is electrically coupled to a radio frequency module so as to receive an electrical signal transmitted by the radio frequency module. The first passive unit includes a regulating circuit that includes a switch, a controller, and a regulating assembly. The regulating assembly includes a plurality of electronic components. The controller is configured to control the switch to connect one or more electronic components of the regulating assembly to the circuit. The connected electronic components make the communication antenna resonate in one of a plurality of frequency ranges.

20 Claims, 5 Drawing Sheets

(51) Int. Cl.

| | |
|---|---|
| ***H01Q 1/48*** | (2006.01) |
| ***H01Q 1/50*** | (2006.01) |
| ***H01Q 9/42*** | (2006.01) |
| ***H01Q 5/371*** | (2015.01) |

(56) References Cited

U.S. PATENT DOCUMENTS

| | | | | |
|---|---|---|---|---|
| 6,188,877 | B1 | 2/2001 | Boesch et al. | |
| 6,298,244 | B1 | 10/2001 | Boesch et al. | |
| 2002/0196192 | A1* | 12/2002 | Nagumo | H01Q 1/38 343/700 MS |
| 2007/0182638 | A1* | 8/2007 | Rowell | H01Q 9/0407 343/700 MS |
| 2008/0266190 | A1* | 10/2008 | Ohba | H01Q 1/243 343/702 |
| 2013/0009829 | A1* | 1/2013 | Kurihara | H01Q 1/243 343/702 |
| 2013/0009847 | A1* | 1/2013 | Alexopoulos | H01Q 1/36 343/893 |
| 2013/0016024 | A1* | 1/2013 | Shi | H01Q 1/243 343/833 |
| 2013/0038494 | A1* | 2/2013 | Kuonanoja | H01Q 9/145 343/746 |
| 2013/0176189 | A1* | 7/2013 | Kodama | H01Q 1/243 343/876 |
| 2013/0243228 | A1 | 9/2013 | Müller | |
| 2014/0323063 | A1 | 10/2014 | Xu et al. | |
| 2015/0181005 | A1* | 6/2015 | Yun | H04M 1/026 455/575.7 |
| 2015/0340757 | A1* | 11/2015 | Rho | H01Q 1/46 343/702 |
| 2015/0380818 | A1* | 12/2015 | Svendsen | H01Q 5/307 343/700 MS |
| 2015/0380825 | A1* | 12/2015 | Ryu | H01Q 1/243 343/727 |
| 2016/0043467 | A1* | 2/2016 | Desclos | H01Q 5/328 343/745 |
| 2016/0064801 | A1 | 3/2016 | Han et al. | |
| 2016/0233574 | A1* | 8/2016 | Xiong | H01Q 5/50 |

FOREIGN PATENT DOCUMENTS

| | | | |
|---|---|---|---|
| CN | 103094717 | A | 5/2013 |
| CN | 103296385 | A | 9/2013 |
| CN | 103313178 | A | 9/2013 |
| CN | 105305067 | A | 2/2016 |

OTHER PUBLICATIONS

Extended European Search Report issued in corresponding EP Application No. 16200574, dated Jun. 16, 2017, 9 pages.

* cited by examiner

COMMUNICATION ANTENNA, METHOD FOR CONTROLLING THE SAME AND TERMINAL

CROSS REFERENCE TO RELATED APPLICATION

This application is based upon and claims priority to Chinese Patent Application Serial No. 201610371760.2, filed with the State Intellectual Property Office of P. R. China on May 30, 2016, the entire contents of which are incorporated herein by reference.

TECHNICAL FIELD

The present disclosure relates to an antenna technology field, and more particularly, to a communication antenna, a method and an apparatus for controlling a communication antenna and a terminal.

BACKGROUND

With the development of terminal technology, mobile terminals having a variety of sizes and appearances have been achieved currently. On one hand, the mobile terminal with a thinner thickness is expected. Moreover, a metal frame is also increasingly applied to the mobile terminal because good feel and outline. On the other hand, demands for communication performance of the mobile terminal become increasingly higher, and a wider communication band is required. However, in the related art, it is difficult to expand the communication band to meet the demands without increasing the thickness of the mobile terminal. Further, some frequency bands have poor communication quality.

SUMMARY

In order to solve the above technical problems, the present disclosure provides a communication antenna, a method and an apparatus for controlling a communication antenna and a terminal.

According to a first aspect of the present disclosure, a communication antenna is provided, which may be applied in a mobile terminal with a metal frame. The communication antenna includes: a first passive unit, a stimulation receiving unit, and a second passive unit. The first passive unit and the second passive unit are respectively coupled to ground. The stimulation receiving unit is electrically coupled to a radio frequency module so as to receive an electrical signal transmitted by the radio frequency module. The first passive unit includes a regulating circuit, which includes a switch, a controller, and a regulating assembly. The regulating assembly further includes a plurality of electronic components. The controller is configured to control the switch to connect one or more electronic components of the regulating assembly to the circuit. Thus, the connected one or more electronic components make the communication antenna resonate in one of a plurality of frequency ranges.

According to a second aspect of the present disclosure, a method for controlling a communication antenna is provided. The method is based on application of the communication antenna according the first aspect or any possible implementation of the first aspect. The method may include: determining a first frequency range where a current communication frequency resides; and selecting a first electronic component corresponding to the first frequency range from the regulating assembly of the first passive unit of the communication antenna and connecting the first electronic component to the circuit, so that the communication antenna is resonated in the first frequency range.

According to a third aspect of the present disclosure, a terminal is provided, which includes: a processor; a communication antenna controlled by the processor, and a memory that stores instructions executable by the processor. The processor is configured to: determine a first frequency range where a current communication frequency resides; and select a first electronic component corresponding to the first frequency range from the regulating assembly of the first passive unit of the communication antenna and connect the first electronic component with the circuit, so that the communication antenna is resonated in the first frequency range. The communication antenna may include a first passive unit, a stimulation receiving unit, and a second passive unit. The first passive unit and the second passive unit are respectively coupled to ground. The stimulation receiving unit is electrically coupled to a radio frequency module so as to receive an electrical signal transmitted by the radio frequency module. The first passive unit includes a regulating circuit that includes a switch, a controller, and a regulating assembly. The regulating assembly includes a plurality of electronic components. The controller is configured to control the switch to connect one or more electronic components of the regulating assembly to the circuit, so as to make the communication antenna to resonate in one of a plurality of frequency ranges.

It is to be understood that both the foregoing general description and the following detailed description are exemplary and explanatory only and are not restrictive of the present disclosure.

BRIEF DESCRIPTION OF THE DRAWINGS

Accompanying drawings herein are incorporated in and constitute a part of the specification, and illustrate exemplary embodiments in line with the present disclosure, and serve to explain the principle of the present disclosure together with the description.

DETAILED DESCRIPTION

Figure 1A:
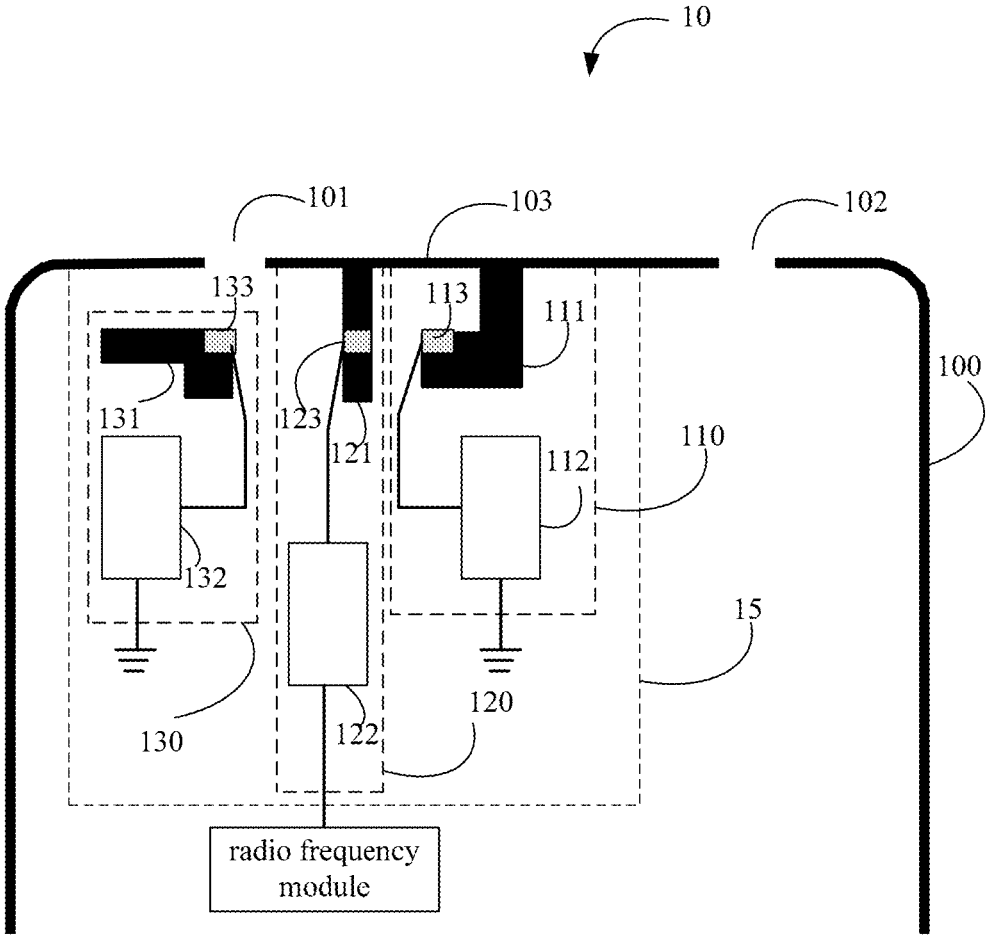
FIG. 1A is a schematic diagram illustrating a communication antenna according to an example embodiment of the present disclosure.

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

Terms used herein in the description of the present disclosure are only for the purpose of describing specific embodiments, but should not be construed to limit the present disclosure. As used in the description of the present disclosure and the appended claims, "a" and "the" in singular forms mean including plural forms, unless clearly indicated in the context otherwise. It should also be understood that, as used herein, the term "and/or" represents and contains any one and all possible combinations of one or more associated listed items.

It is to be understood that, although terms of "first", "second" and "third" are used for description of various information in the present disclosure, these information are not limited to these terms. These terms are only used for distinguishing information with the same type. For example, without departing from the scope of the present disclosure, the first information may also be referred to as the second information; similarly, the second information may also be referred to as the first information. Depending on the context, such as the words in the use of "if" can be interpreted as "when . . . " or "when . . . " or "response to define". Terms such as "longitudinal", "lateral", "upper", "lower", "front", "rear", "right", "left", "horizontal", "vertical", "above", "below", "up", "top", "bottom", "inner", "outer", as well as derivative thereof should be construed to refer to the orientation as then described or as shown in the drawings under discussion. These relative terms are for convenience of description and do not require that the present disclosure be constructed or operated in a particular orientation.

It should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings, which can be understood by those skilled in the art according to the detail embodiment of the present disclosure.

FIG. 1A is a schematic diagram illustrating a communication antenna according to an example embodiment of the present disclosure. The communication antenna is configured to be applied in a mobile terminal with a metal frame. It can be understood by those skilled in the art that, the mobile terminal may include but be not limited to a mobile terminal device such as a smart phone, a smart wearable device, a tablet, a personal digital assistant and the like.

As shown in FIG. 1A, a first break gap 101 and a second break gap 102 are disposed on a same side of the metal frame 100 of the mobile terminal 10. It can be understood that, the first break gap 101 and the second break gap 102 may be formed at any other location of the metal frame 100, which is not limited in embodiments of the present disclosure. For a brief description, the first break gap 101 and the second break gap 102 shown in FIG. 1A are illustrated as an example in all the following embodiments of the present disclosure. The mobile terminal 10 includes a communication antenna 15 that includes a first passive unit 110, a stimulation receiving unit 120, and a second passive unit 130.

Here, the first passive unit 110 may include a first antenna pattern 111 and a regulating circuit 112. The first antenna pattern 111 is disposed around the first break gap 101. A first terminal of the first antenna pattern 111 is electrically coupled to the part of the metal frame 103 between the first break gap 101 and the second break gap 102, and a second terminal of the first antenna pattern 111 is provided with a first grounding node 113. The first antenna pattern 111 may be electrically coupled to a first terminal of the regulating circuit 112 via the first grounding node 113, and a second terminal of the regulating circuit 112 is coupled to ground.

The regulating circuit 112 may include a switch, a controller, and a regulating assembly. The regulating assembly includes a plurality of electronic components, such as a resistor, a capacitor, or an inductor, or the like. The controller is configured to control the switch to connect different electronic components of the regulating assembly with the circuit under different communication requirements, so as to make the communication antenna resonated in one of a plurality of frequency ranges.

Figure 1B:
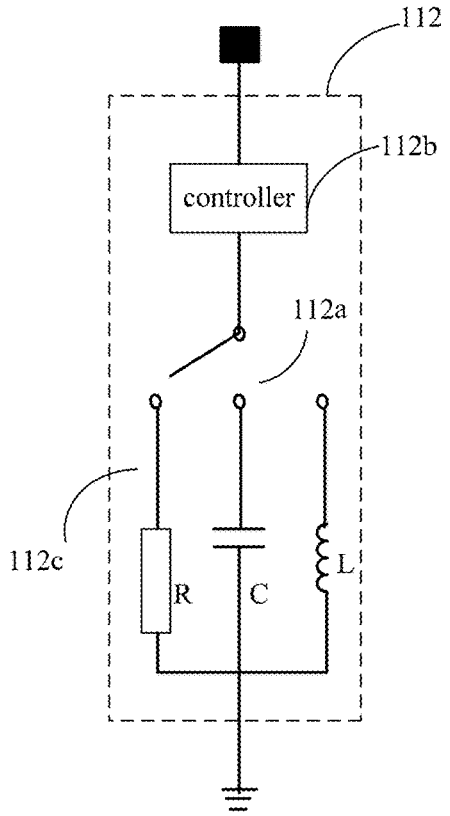
FIG. 1B is a schematic diagram illustrating a circuit structure of a regulating circuit according to an example embodiment of the present disclosure.

For example, FIG. 1B is a schematic diagram illustrating a circuit structure of a regulating circuit according to an example embodiment of the present disclosure. As shown in FIG. 1B, the regulating circuit 112 may include a switch 112*a*, a controller 112*b*, and a regulating assembly 112*c*. The regulating assembly 112*c* includes a resistor R, a capacitor C, or an inductor L. Every time the switch 112*a* is able to only connect one of the resistor R, the capacitor C and the inductor L with the circuit. Such as a resistance value of the resistor is equal to 0Ω; a capacitance value of the capacitor is in a range of 0.5 pF to 15 pF; and an inductance value of the inductor is in a range of 1 nH to 22 nH. Under a condition that the resistor R is connected to the circuit, the above communication antenna may meet the communication requirements in a band range of 824 MHz to 894 MHz; under a condition that the capacitor C is connected to the circuit, the above communication antenna may meet the communication requirements in a band range of 880 MHz to 960 MHz; and under a condition that the inductor L is connected to the circuit, the above communication antenna may meet the communication requirements in a band range of 699 MHz to 803 MHz. It should be noted that, the above resistor with the resistance value of 0Ω may be replaced with a wire or a line, which is not limited in embodiments of the present disclosure. In the disclosure, by switching the electronic components in the regulating assembly 112*c*, the communication frequency bands of the communication antenna is extended, thereby the communication frequency bands of the communication antenna may cover a band range of 700 MHz to 2700 MHz. In some example, the above resistor may have a resistance value less than a predetermined threshold, which may be 0.5Ω or less.

The stimulation receiving unit 120 may include a second antenna pattern 121 and a first matching circuit 122. The second antenna pattern 121 is disposed around the first break gap 101. A first terminal of the second antenna pattern 121 is electrically coupled to the part of the metal frame 103 between the first break gap 101 and the second break gap 102. A feeding node 123 is disposed on the second antenna pattern 121. The second antenna pattern 121 may be electrically coupled to a first terminal of the first matching circuit 122 via the feeding node 123, and a second terminal of the first matching circuit 122 is coupled to the radio frequency module, so as to receive an electrical signal transmitted by the radio frequency module.

The first matching circuit 122 may at least include a first capacitor. The first capacitor may be coupled between the feeding node 123 and the radio frequency module. The first matching circuit 122 may further include a second capacitor, a first inductor and a second inductor. In the disclosure, parameter configuration may be performed on the first capacitor, the second capacitor, the first inductor and the second inductor, so that an impedance of the first matching circuit 122 is about 50Ω. By performing the parameter configuration on the electronic components in the first matching circuit 122, fine adjustment of the oscillation frequency on full-band of the communication antenna may be realized.

Figure 1C:
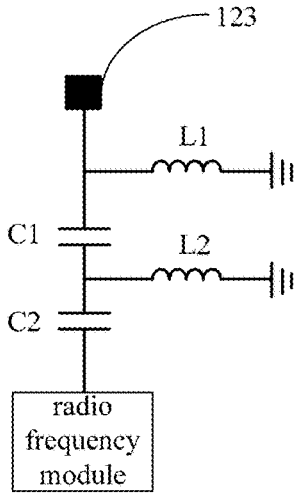
FIG. 1C is a schematic diagram illustrating a circuit structure of a first matching circuit according to an example embodiment of the present disclosure.

For example, FIG. 1C is a schematic diagram illustrating a circuit structure of a first matching circuit according to an example embodiment of the present disclosure. As shown in FIG. 1C, the first matching circuit includes a first capacitor C1, a second capacitor C2, a first inductor L1 and a second inductor L2. A first terminal of the first capacitor C1 is connected to the feeding node 123, and a second terminal of the first capacitor C1 is connected to a first terminal of the second capacitor C2, and a second terminal of the second capacitor C2 is connected to the radio frequency module. A first terminal of the first inductor L1 is connected to the feeding node 123, and a second terminal of the first inductor L1 is connected to ground. A first terminal of the second inductor L2 is connected to a connecting node of the first capacitor C1 and the second capacitor C2, and a second terminal of the second inductor L2 is connected to ground.

The second passive unit 130 may include a third antenna pattern 131 and a second matching circuit 132. The third antenna pattern 131 is disposed around the first break gap 101. A second grounding node 133 is disposed on the third antenna pattern 131. The third antenna pattern 131 may be electrically coupled to a first terminal of the second matching circuit 132 via the second grounding node 133, and a second terminal of the second matching circuit 132 is coupled to ground.

The second matching circuit 132 may include a resistor. A first terminal of the resistor may be connected to the second grounding node 133, and a second terminal thereof is connected to ground. A resistance value of the resistor may be 0Ω. It should be noted that, the above resistor with the resistance value of 0Ω may be replaced with a wire or a line, which is not limited in embodiments of the present disclosure.

The feeding node 123 is disposed between the first grounding node 113 and the second grounding node 133.

In the communication antenna provided in the above embodiments of the present disclosure, the regulating circuit is disposed in the first passive unit, the regulating circuit includes the switch, the controller and the regulating assembly, the regulating assembly includes the plurality of electronic components, and the controller is configured to control the switch to connect one or more electronic components of the regulating assembly to the circuit, so as to make the communication antenna resonated in different frequency ranges, thereby extending communication frequency bands of the communication antenna, and further meeting communication requirements in different frequency bands.

Figure 2:
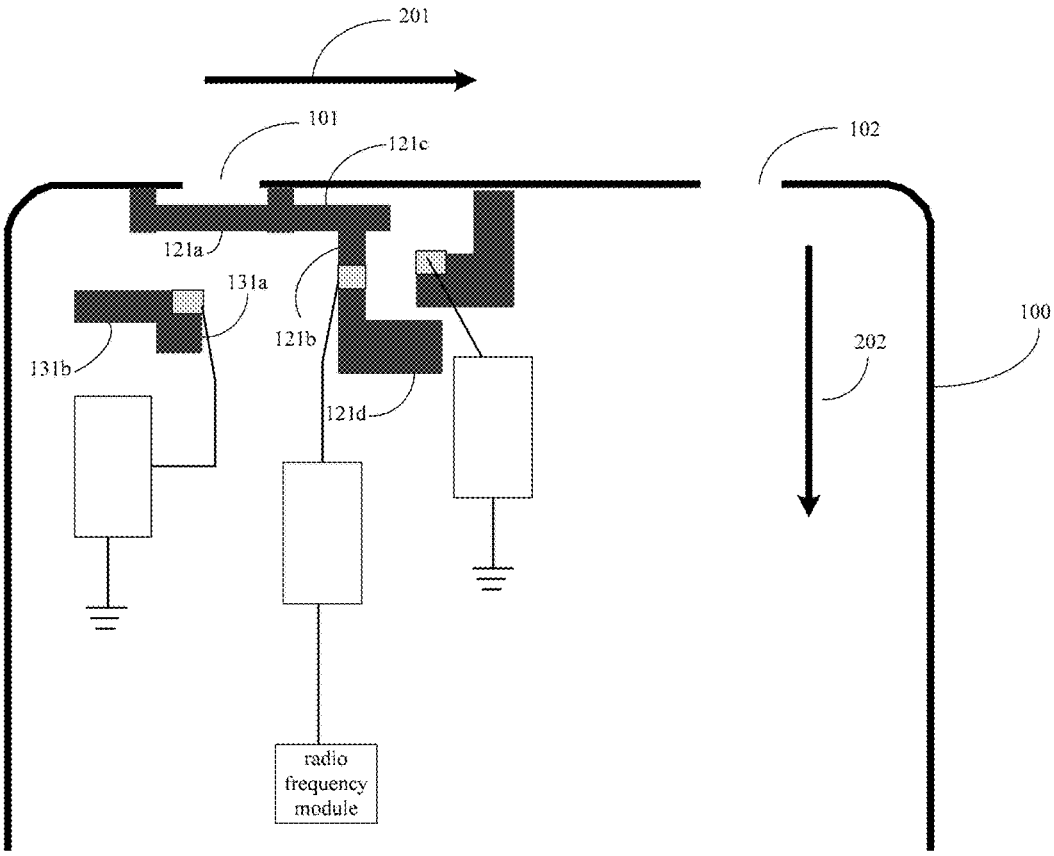
FIG. 2 is a schematic diagram illustrating another communication antenna according to an example embodiment of the present disclosure.

FIG. 2 is a schematic diagram illustrating another communication antenna according to an example embodiment of the present disclosure. The communication antenna is configured to be applied in a mobile terminal with a metal frame. As shown in FIG. 2, a first break gap 101 and a second break gap 102 are formed at a same side of the metal frame 100 of the mobile terminal. It can be understood that, the first break gap 101 and the second break gap 102 may be formed at any other location of the metal frame 100, which is not limited in embodiments of the present disclosure. The communication antenna includes a first passive unit, a stimulation receiving unit, and a second passive unit.

Additionally or alternatively, the stimulation receiving unit may include a second antenna pattern and a first matching circuit. The second antenna pattern may include a connecting portion 121*a* and a feeding portion 121*b*. Parts of the metal frame at two sides of the first break gap 101 are electrically coupled by the connecting portion 121*a*. The feeding node is disposed on the feeding portion 121*b*. A first parasitic branch 121*c* is extended from the connecting portion 121*a* in a first direction. A second parasitic branch 121*d* is extended from the feeding portion 121*b* in a second direction. The first parasitic branch 121*c* is electrically coupled to the feeding portion 121*b*. A direction indicated by an arrow 201 refers to the first direction, which is a direction from the first break gap to the second break gap from. A direction indicated by an arrow 202 refers to the second direction, which is a direction perpendicular to the first direction and pointing to the metal frame.

The second passive unit may include a third antenna pattern and a second matching circuit. The third antenna pattern may include a grounding portion 131*a*. A second grounding node is disposed on the grounding portion 131*a*. A third parasitic branch 131*b* is extended from the grounding portion 131*a* in a direction opposite to the first direction.

In the disclosure, the first parasitic branch 121*c* extended from the connecting portion 121*a* may play a role of regulating communication frequency bands of high frequency, thereby improving communication quality of the frequency bands. The second parasitic branch 121*d* extended from the feeding portion 121*b* may play a role of regulating communication frequency bands of a band range of 2300 MHz to 2400 MHz and a band range of 2500 MHz to 2700 MHz, thereby improving communication quality of the above frequency bands. The third parasitic branch 131*b* extended from the grounding portion 131*a* may play a role of regulating communication frequency bands of a band range of 1710 MHz to 2170 MHz, thereby improving communication quality of this frequency band.

It should be noted that, the same contents in embodiments of FIG. 1A are not elaborated herein again in embodiments of FIG. 2. Details undisclosed may be referred to the above embodiments of FIG. 1A.

In the communication antenna provided in the above embodiments of the present disclosure, the parts of the metal frame at two sides of the first break gap are electrically coupled via the connecting portion of the stimulation receiving unit, the first parasitic branch is extended from the connecting portion of the stimulation receiving unit, and the second parasitic branch is extended from the feeding portion of the stimulation receiving unit, so as to regulate some communication frequency bands, thus improving communication quality of these communication frequency bands.

In the disclosure, the coupling volume of each frequency band may be adjusted by distances among the first antenna pattern, the second antenna pattern and the third antenna pattern, trace thickness, trace length, etc., so that the adjustment of the communication quality of different frequency bands may be realized. Meanwhile, it should be noted that the first antenna pattern, the second antenna pattern and the third antenna pattern should be separated apart from metal components, such as USB interface, microphone or motor, so as to reduce effects of these metal components on antenna performance. For example, for the USB interface, shrapnel at two sides of the USB interface may be as the ground node, thereby reducing the effects of the USB interface on the antenna.

Figure 3:
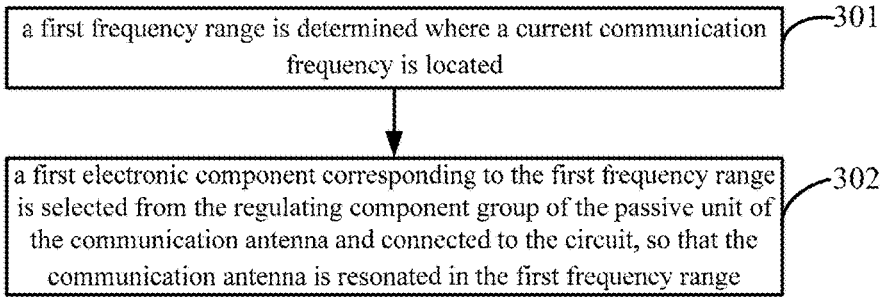
FIG. 3 is a flow chart showing a method for controlling a communication antenna according to an example embodiment of the present disclosure.

FIG. 3 is a flow chart showing a method for controlling a communication antenna according to an example embodiment of the present disclosure. As shown in FIG. 3, the method is applied in a mobile terminal. The method is based on application of the communication antenna according to embodiments of FIG. 1A and FIG. 2. In the disclosure, it can be understood by those skilled in the art that, the mobile terminal may include but be not limited to a mobile terminal device such as a smart phone, a smart wearable device, a tablet, a personal digital assistant and the like. The method includes followings.

In block 301, a first frequency range is determined where a current communication frequency resides. The frequency range covers the current communication frequency used by the mobile terminal device.

In block 302, a first electronic component corresponding to the first frequency range is selected from the regulating assembly of the passive unit of the communication antenna and is connected to the circuit, so that the communication antenna is resonated at the first frequency range.

In general, the frequency band of the terminal communication is wide. In addition, with the development of communication technology, the frequency band of the communication will become wider. Therefore the communication antenna needs to work in different frequency bands to meet different communication requirements.

In the disclosure, the regulating assembly of the first passive unit of the communication antenna may include a plurality of electronic components, such as a resistor, a capacitor, an inductor, and the like. The controller of the first passive unit of the communication antenna may control the switch to connect different electronic components of the regulating assembly to the circuit. Different electronic components are connected to the circuit, so that the communication antenna may be resonated in different frequency ranges, and each electronic component may correspond to a certain frequency range. For example, when the resistor is connected to the circuit, the communication antenna is resonated in a band range of 824 MHz to 894 MHz. When the capacitor is connected to the circuit, the communication antenna is resonated in a band range of 880 MHz to 960 MHz. When the inductor is connected into the circuit, the communication antenna is resonated in a band range of 699 MHz to 803 MHz. Correspondence information of frequency ranges and electronic components may be predetermined and stored in a non-transitory storage. For example, the resistor is corresponding to the band range of 824 MHz to 894 MHz, the capacitor is corresponding to the band range of 880 MHz to 960 MHz and the inductor is corresponding to the band range of 699 HMz to 803 MHz. Then the predetermined correspondence information of frequency ranges and electronic components may be stored locally on the mobile terminal, remotely in a database, or both locally and remotely.

In the disclosure, firstly the first frequency range is determined where the current communication frequency resides. For example, when the phone number needs to be dialed via the terminal, the band is determined where the phone communication is. Then, the correspondence information of frequency ranges and electronic components is acquired from pre-stored data. The electronic component corresponding to the first frequency range is found out from the correspondence information and to be used as the first electronic component. The first electronic component is connected to the circuit via the switch, so that the communication antenna may meet the requirements of the telephone communication.

With the method for controlling a communication antenna provided in the above embodiments of the present disclosure, the first frequency range is determined where the current communication frequency resides, and then the first electronic component corresponding to the first frequency range is selected from the regulating assembly of the first passive unit of the communication antenna and connected to the circuit, so that the communication antenna is resonated in the first frequency range. Communication frequency bands of the communication antenna are extended, thereby meeting communication requirements of the current communication.

Although the method of the present disclosure is performed in an order as shown in drawings, this does not require or imply that the method must be performed according to the specific order or a desired result may be achieved only if all blocks of the method are performed in this order. In contrast, blocks depicted in the flow charts may be performed in a changeable order. Additionally or alternatively, some blocks may be omitted, multiple blocks may be combined as one, and/or one block may be divided into multiple blocks.

Corresponding to the aforementioned embodiments of the method for controlling a communication antenna, embodiments of an apparatus for controlling a communication antenna and a terminal applying the apparatus are also provided by the present disclosure.

Figure 4:
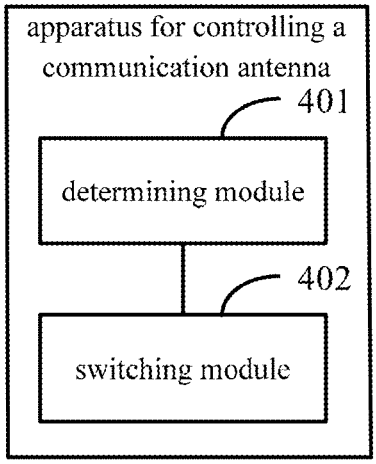
FIG. 4 is a block diagram illustrating an apparatus for controlling a communication antenna according to an example embodiment of the present disclosure.

FIG. 4 is a block diagram illustrating an apparatus for controlling a communication antenna according to an example embodiment of the present disclosure. As shown in FIG. 4, the apparatus is based on application of the communication antenna according to embodiments of FIG. 1A and FIG. 2. The apparatus includes a determining module 401 and a switching module 402.

The determining module 401 is configured to determine a first frequency range where a current communication frequency resides.

The switching module 402 is configured to select a first electronic component corresponding to the first frequency range from the regulating assembly of the first passive unit of the communication antenna and connect the first electronic component to the circuit, so that the communication antenna is resonated in the first frequency range.

Figure 5:
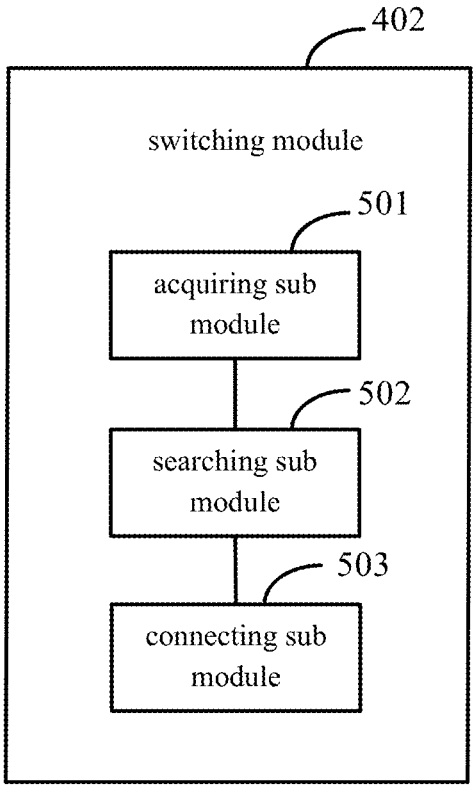
FIG. 5 is a block diagram illustrating another apparatus for controlling a communication antenna according to an example embodiment of the present disclosure.

FIG. 5 is a block diagram illustrating another apparatus for controlling a communication antenna according to an example embodiment of the present disclosure. As shown in FIG. 5, based on the embodiment of the present disclosure shown in FIG. 4, the switching module 402 includes an acquiring sub module 501, a searching sub module 502 and a connecting sub module 503.

The acquiring sub module 501 is configured to acquire correspondence information of frequency ranges and electronic components from pre-stored data.

The searching sub module 502 is configured to search for the first electronic component corresponding to the first frequency range in the correspondence information.

The connecting sub module 503 is configured to connect the first electronic component to the circuit via the switch.

It should be appreciated that the apparatus may be set in advance in the terminal, and may also be downloaded and loaded into the terminal. Corresponding modules in the apparatus may be cooperated with modules in the terminal to achieve a control scheme of the communication antenna.

For the apparatus embodiments, since they are substantially corresponded to the method embodiments, contents of the apparatus embodiments related to the device embodiments may also refer to the method embodiments. The above-described apparatus embodiments are merely illustrative, in which a unit described as a separate component may or may not be physically separated, a component displayed as a unit may or may not be a physical unit, i.e. may be located at one place, or may be distributed on multiple network units. A part or all of the modules may be selected according to practical needs so as to achieve the object of the solution of the present disclosure, which may be understood and implemented by those skilled in the art without creative labor.

Correspondingly, embodiments of the present disclosure also provide a terminal. The terminal includes a processor; and a memory configured to store an instruction executable by the processor. The processor is configured to:

determine a first frequency range where a current communication frequency resides; and select a first electronic component corresponding to the first frequency range from the regulating assembly of the first passive unit of the communication antenna and connect the first electronic component to the circuit, so that the communication antenna is resonated in the first frequency range.

Figure 6:
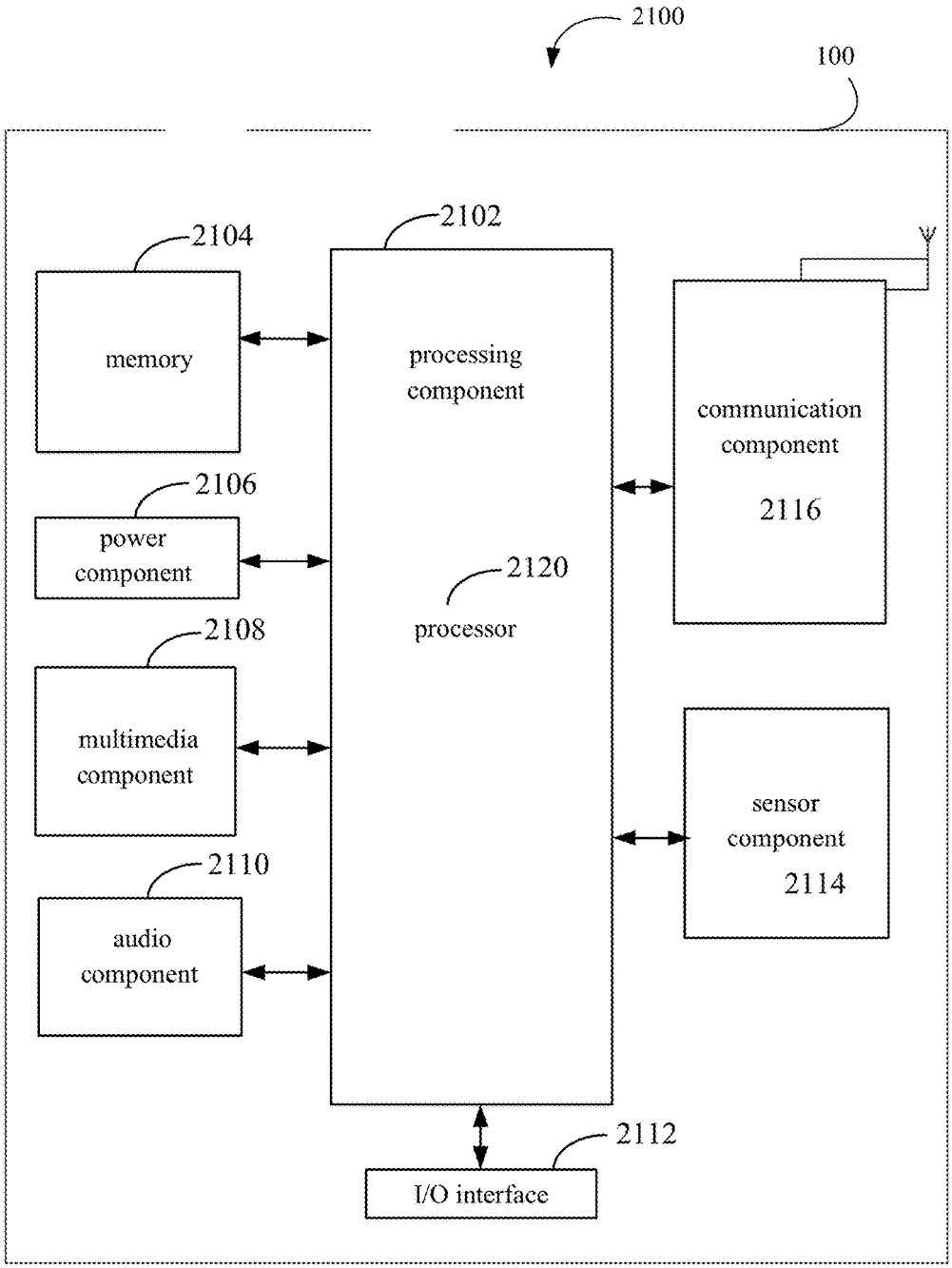
FIG. 6 is a schematic diagram illustrating a device for controlling a communication antenna according to an example embodiment of the present disclosure.

FIG. 6 is a schematic diagram illustrating a device 2100 for controlling a communication antenna according to an example embodiment of the present disclosure. For example, the device 2100 may be a mobile phone, a computer, a digital broadcasting terminal, a messaging device, a game console, a tablet device, a fitness equipment, a medical device, a Personal Digital Assistant PDA, etc.

Referring to FIG. 6, the device 2100 may include a metal frame 100 that surrounds the following one or more components: a processing component 2102, a memory 2104, a power component 2106, a multimedia component 2108, an audio component 2110, an Input/Output (I/O) interface 2112, a sensor component 2114, and a communication component 2116. The metal frame may include multiple sections.

The processing component 2102 typically controls overall operations of the device 2100, such as the operations associated with display, telephone calls, data communications, camera operations, and recording operations. The processing component 2102 may include one or more processors 2120 to execute instructions to perform all or part of the blocks in the above described methods. Moreover, the processing component 2102 may include one or more modules which facilitate the interaction between the processing component 2102 and other components. For instance, the processing component 2102 may include a multimedia module to facilitate the interaction between the multimedia component 2108 and the processing component 2102.

The memory 2104 is configured to store various types of data to support the operation of the device 2100. Examples of such data include instructions for any applications or methods operated on the device 2100, contact data, phonebook data, messages, pictures, video, etc. The memory 2104 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 2106 provides power to various components of the device 2100. The power component 2106 may include a power management system, one or more power sources, and any other components associated with the generation, management, and distribution of power in the device 2100.

The multimedia component 2108 includes a screen providing an output interface between the device 2100 and the user. In some embodiments, the screen may include a liquid crystal display (LCD) and a press panel (TP). If the screen includes the press panel, the screen may be implemented as a press screen to receive input signals from the user. The press panel includes one or more press sensors to sense presses, swipes, and other gestures on the press panel. The press sensors may not only sense a boundary of a press or swipe action, but also sense a duration time and a pressure associated with the press or swipe action. In some embodiments, the multimedia component 2108 includes a front camera and/or a rear camera. The front camera and/or the rear camera may receive external multimedia data while the device 2100 is in an operation mode, such as a photographing mode or a video mode. Each of the front camera and the rear camera may be a fixed optical lens system or have focus and optical zoom capability.

The audio component 2110 is configured to output and/or input audio signals. For example, the audio component 2110 includes a microphone (MIC) configured to receive an external audio signal when the device 2100 is in an operation mode, such as a call mode, a recording mode, and a voice recognition mode. The received audio signal may be further stored in the memory 2104 or transmitted via the communication component 2116. In some embodiments, the audio component 2110 further includes a speaker to output audio signals.

The I/O interface 2112 provides an interface for the processing component 2102 and peripheral interface modules, such as a keyboard, a click wheel, buttons, and the like. The buttons may include, but are not limited to, a home button, a volume button, a starting button, and a locking button.

The sensor component 2114 includes one or more sensors to provide status assessments of various aspects of the device 2100. For instance, the sensor component 2114 may detect an open/closed status of the device 2100 and relative positioning of components (e.g. the display and the keypad of the device 2100). The sensor component 2114 may also detect a change in position of the device 2100 or of a component in the device 2100, a presence or absence of user contact with the device 2100, an orientation or an acceleration/deceleration of the device 2100, and a change in temperature of the device 2100. The sensor component 2114 may include a proximity sensor configured to detect the presence of nearby objects without any physical contact. The sensor component 2114 may also include a light sensor, such as a CMOS or CCD image sensor, for use in imaging applications. In some embodiments, the sensor component 2114 may also include an accelerometer sensor, a gyroscope sensor, a magnetic sensor, a pressure sensor, or a temperature sensor.

The communication component 2116 is configured to facilitate wired or wireless communication between the device 2100 and other devices. The device 2100 can access a wireless network based on a communication standard, such as WIFI, 3G, 4G, or a combination thereof. For example, the communication component 2116 may include one or more antenna described above. In one exemplary embodiment, the communication component 2116 receives a broadcast signal or broadcast associated information from an external broadcast management system via a broadcast channel. In one exemplary embodiment, the communication component 2116 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 2100 may be implemented with one or more circuitries, which include application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components. The apparatus may use the circuitries in combination with the other hardware or software components for performing the above described methods. Each module, sub-module, unit, or sub-unit in the disclosure may be implemented at least partially using the one or more circuitries.

In exemplary embodiments, there is also provided a non-transitory computer readable storage medium including instructions, such as the memory 2104 including instructions. The above instructions are executable by the processor 2120 in the device 2100, for performing the above-described methods. For example, the non-transitory computer-readable storage medium may be a ROM, a RAM, a CD-ROM, a magnetic tape, a floppy disc, an optical data storage device, and the like.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing form the scope thereof. It is intended that the scope of the invention only be limited by the appended claims.

What is claimed is:

1. A communication antenna applied in a mobile terminal with a metal frame, comprising:

a first passive unit comprising a regulating circuit, a stimulation receiving unit, and a second passive unit, wherein the first passive unit and the second passive unit are respectively coupled to ground, the stimulation receiving unit is electrically coupled to a radio frequency module so as to receive an electrical signal transmitted by the radio frequency module;

wherein the regulating circuit comprises a switch, a controller, and a regulating assembly, the regulating assembly comprises a plurality of electronic components, and the controller is configured to control the switch to connect one or more electronic components of the regulating assembly to the circuit, the connected one or more electronic components making the communication antenna to resonate in one of a plurality of frequency ranges, and wherein the stimulation receiving unit comprises a second antenna pattern and a first matching circuit, a feeding node is disposed on the second antenna pattern, the second antenna pattern is electrically coupled to a first terminal of the first matching circuit via the feeding node, a second terminal of the first matching circuit is coupled to the radio frequency module.

2. The communication antenna according to claim 1, wherein the first passive unit further comprises a first antenna pattern, a first grounding node is disposed on the first antenna pattern, the first antenna pattern is electrically coupled to a first terminal of the regulating circuit via the first grounding node, a second terminal of the regulating circuit is coupled to ground;

the second passive unit comprises a third antenna pattern and a second matching circuit, a second grounding node is disposed on the third antenna pattern, the third antenna pattern is electrically coupled to a first terminal of the second matching circuit via the second grounding node, a second terminal of the second matching circuit is coupled to ground, wherein the feeding node is disposed between the first grounding node and the second grounding node;

a first break gap and a second break gap are formed at a same side of the metal frame, the first antenna pattern, the second antenna pattern and the third antenna pattern are disposed around the first break gap, and the first antenna pattern and the second antenna pattern are electrically coupled to a part of the metal frame between the first break gap and the second break gap respectively.

3. The communication antenna according to claim 2, wherein the second antenna pattern comprises a connecting portion and a feeding portion, parts of the metal frame at two sides of the first break gap are electrically coupled by the connecting portion, and the feeding node is disposed on the feeding portion.

4. The communication antenna according to claim 3, wherein a first parasitic branch is extended from the connecting portion in a first direction, a second parasitic branch is extended from the feeding portion in a second direction, the first parasitic branch is electrically coupled to the feeding portion, in which the first direction is a direction from the first break gap to the second break gap, and the second direction is a direction perpendicular to the first direction and pointing to the metal frame.

5. The communication antenna according to claim 1, wherein the regulating assembly comprises a resistor, a capacitor, and an inductor;

wherein when the resistor is connected to the first antenna pattern, the communication antenna resonates in a band range of 824 MHz to 894 MHz;

wherein when the capacitor is connected to the first antenna pattern, the communication antenna resonates in a band range of 880 MHz to 960 MHz; and wherein when the inductor is connected to the first antenna pattern, the communication antenna resonates in a band range of 699 MHz to 803 MHz.

6. The communication antenna according to claim 5, wherein a resistance value of the resistor is equal to 0Ω;

a capacitance value of the capacitor is in a range of 0.5 pF to 15 pF; and an inductance value of the inductor is in a range of 1 nH to 22 nH.

7. A method, comprising:

providing a communication antenna in a mobile terminal including a metal frame, the communication antenna comprising a first passive unit, a stimulation receiving unit, and a second passive unit;

coupling the first passive unit and the second passive unit respectively to ground, wherein the stimulation receiving unit is electrically coupled to a radio frequency module so as to receive an electrical signal transmitted by the radio frequency module;

providing a regulating circuit in the first passive unit, the regulating circuit comprises a switch, a controller and a regulating assembly, the regulating assembly comprises a plurality of electronic components;

controlling, by the controller, the switch to connect one or more electronic components of the regulating assembly to the circuit, and making the communication antenna to resonate in one of a plurality of frequency ranges, providing a second antenna pattern and a first matching circuit in the stimulation receiving unit and disposing a feeding node on the second antenna pattern, wherein the second antenna pattern is electrically coupled to a first terminal of the first matching circuit via the feeding node, a second terminal of the first matching circuit is coupled to the radio frequency module, determining a first frequency range where a current communication frequency resides; and selecting a first electronic component corresponding to the first frequency range from the regulating assembly of the first passive unit of the communication antenna and connecting the first electronic component to the circuit, so that the communication antenna is resonated in the first frequency range.

8. The method according to claim 7, wherein selecting the first electronic component corresponding to the first frequency range from the regulating assembly of the first passive unit of the communication antenna and connecting the first electronic component to the circuit comprises:

acquiring correspondence information of frequency ranges and electronic components from pre-stored data;

searching for the first electronic component corresponding to the first frequency range in the correspondence information; and controlling the switch to connect the first electronic component to the circuit.

9. The method according to claim 7, wherein the first passive unit further comprises a first antenna pattern, a first grounding node is disposed on the first antenna pattern, the first antenna pattern is electrically coupled to a first terminal of the regulating circuit via the first grounding node, a second terminal of the regulating circuit is coupled to ground;

the second passive unit comprises a third antenna pattern and a second matching circuit, a second grounding node is disposed on the third antenna pattern, the third antenna pattern is electrically coupled to a first terminal of the second matching circuit via the second grounding node, a second terminal of the second matching circuit is coupled to ground, wherein the feeding node is disposed between the first grounding node and the second grounding node;

a first break gap and a second break gap are formed at a same side of the metal frame, the first antenna pattern, the second antenna pattern and the third antenna pattern are disposed around the first break gap, and the first antenna pattern and the second antenna pattern are electrically coupled to a part of the metal frame between the first break gap and the second break gap respectively.

10. The method according to claim 9, wherein the second antenna pattern comprises a connecting portion and a feeding portion, parts of the metal frame at two sides of the first break gap are electrically coupled by the connecting portion, and the feeding node is disposed on the feeding portion.

11. The method according to claim 10, wherein a first parasitic branch is extended from the connecting portion in a first direction, a second parasitic branch is extended from the feeding portion in a second direction, the first parasitic branch is electrically coupled to the feeding portion, in which the first direction is a direction from the first break gap to the second break gap, and the second direction is a direction perpendicular to the first direction and pointing to the metal frame.

12. The method according to claim 7, wherein the regulating assembly comprises a resistor, a capacitor and an inductor.

13. The method according to claim 12, wherein a resistance value of the resistor is equal to 0Ω;

a capacitance value of the capacitor is in a range of 0.5 pF to 15 pF; and an inductance value of the inductor is in a range of 1 nH to 22 nH.

14. A terminal, comprising:

a processor;

a memory circuitry configured to store an instruction executable by the processor; and a metal frame at least partially surrounding the processor and the memory circuitry;

wherein the processor is configured to:

determine a first frequency range where a current communication frequency resides; and select a first electronic component corresponding to the first frequency range from a regulating assembly of a first passive unit of a communication antenna and connect the first electronic component to a circuit, so that the communication antenna is resonated in the first frequency range, wherein the communication antenna comprises a first passive unit, a stimulation receiving unit, and a second passive unit, wherein the first passive unit and the second passive unit are coupled to ground respectively, the stimulation receiving unit is electrically coupled to a radio frequency module so as to receive an electrical signal transmitted by the radio frequency module;

the first passive unit comprises a regulating circuit, the regulating circuit comprises a switch, a controller and a regulating assembly, the regulating assembly comprises a plurality of electronic components, and the controller is configured to control the switch to connect one or more electronic components of the regulating assembly to the circuit, so as to make the communication antenna to resonate in one of a plurality of frequency ranges, and the stimulation receiving unit comprises a second antenna pattern and a first matching circuit, a feeding node is disposed on the second antenna pattern, the second antenna pattern is electrically coupled to a first terminal of the first matching circuit via the feeding node, a second terminal of the first matching circuit is coupled to the radio frequency module.

15. The terminal according to 14, wherein the processor is further configured to:

acquiring correspondence information of frequency ranges and electronic components from pre-stored data;

searching for the first electronic component corresponding to the first frequency range in the correspondence information; and controlling the switch to connect the first electronic component to the circuit.

16. The terminal according to claim 14, wherein the first passive unit further comprises a first antenna pattern, a first grounding node is disposed on the first antenna pattern, the first antenna pattern is electrically coupled to a first terminal of the regulating circuit via the first grounding node, a second terminal of the regulating circuit is coupled to ground;

the second passive unit comprises a third antenna pattern and a second matching circuit, a second grounding node is disposed on the third antenna pattern, the third antenna pattern is electrically coupled to a first terminal of the second matching circuit via the second grounding node, a second terminal of the second matching circuit is coupled to ground, wherein the feeding node is disposed between the first grounding node and the second grounding node;

a first break gap and a second break gap are formed at a same side of the metal frame, the first antenna pattern, the second antenna pattern and the third antenna pattern are disposed around the first break gap, and the first antenna pattern and the second antenna pattern are electrically coupled to a part of the metal frame between the first break gap and the second break gap respectively.

17. The terminal according to claim 16, wherein the second antenna pattern comprises a connecting portion and a feeding portion, parts of the metal frame at two sides of the first break gap are electrically coupled by the connecting portion, and the feeding node is disposed on the feeding portion.

18. The terminal according to claim 17, wherein a first parasitic branch is extended from the connecting portion in a first direction, a second parasitic branch is extended from the feeding portion in a second direction, the first parasitic branch is electrically coupled to the feeding portion, in which the first direction is a direction from the first break gap to the second break gap, and the second direction is a direction perpendicular to the first direction and pointing to the metal frame.

19. The terminal according to claim 14, wherein the regulating assembly comprises a resistor, a capacitor, and an inductor; and wherein the communication antenna is extended to cover a band range of 700 MHz to 2700 MHz by switching among the resistor, the capacitor, and the inductor in the regulating assembly.

20. The terminal according to claim 19, wherein a resistance value of the resistor is equal to 0Ω;

a capacitance value of the capacitor is in a range of 0.5 pF to 15 pF; and an inductance value of the inductor is in a range of 1 nH to 22 nH.

* * * * *